US008191990B2

(12) United States Patent
Kita et al.

(10) Patent No.: US 8,191,990 B2
(45) Date of Patent: Jun. 5, 2012

(54) INKJET RECORDING APPARATUS

(75) Inventors: Yoshirou Kita, Nagoya (JP); Kenji Kuroki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1057 days.

(21) Appl. No.: 12/053,552

(22) Filed: Mar. 21, 2008

(65) Prior Publication Data

US 2008/0291239 A1 Nov. 27, 2008

(51) Int. Cl.
*B41J 2/165* (2006.01)

(52) U.S. Cl. ..... 347/33; 347/22

(58) Field of Classification Search ..... None
See application file for complete search history.

(56) References Cited

U.S. PATENT DOCUMENTS

| | | | | |
|---|---|---|---|---|
| 5,396,277 | A | 3/1995 | Gast et al. | |
| 6,155,666 | A | 12/2000 | Sugimoto et al. | |
| 6,213,582 | B1 | 4/2001 | Uchida et al. | |
| 6,364,449 | B1 * | 4/2002 | Takahashi et al. | 347/30 |
| 6,866,361 | B2 | 3/2005 | Kuki et al. | |

FOREIGN PATENT DOCUMENTS

| | | | |
|---|---|---|---|
| JP | H03-262646 | A | 11/1991 |
| JP | H06-210863 | A | 8/1994 |
| JP | H07-241995 | A | 9/1995 |
| JP | H08-281968 | A | 10/1996 |
| JP | 2001-179999 | A | 7/2001 |
| JP | 2004-098408 | A | 4/2004 |
| JP | 2004-167928 | A | 6/2004 |

OTHER PUBLICATIONS

Japan Patent Office, Notice of Reasons for Rejection for Japanese Patent Application No. 2007-074330 (counterpart to above-captioned patent application), mailed Sep. 7, 2010. (Partial English translation attached.).

* cited by examiner

*Primary Examiner* — Matthew Luu
*Assistant Examiner* — Erica Lin
(74) *Attorney, Agent, or Firm* — Baker Botts L.L.P.

(57) ABSTRACT

An inkjet recording apparatus has an inkjet head with an ejection surface. The ejection surface has a first end, and a second end opposite the first end. The ejection surface also has a first and second control portion, and a contact portion located between the first control portion and the second control portion. Additionally, a number of ejection ports are formed through the ejection surface. The inkjet recording apparatus also includes a wiper and a wiper moving mechanism. The wiper moving mechanism moves the wiper between the first end and the second end. When the wiper is located over the contact portion, the wiper contacts the ejection surface, and when the wiper is located over the first or second control portions, the wiper is located away from the ink ejection surface.

12 Claims, 10 Drawing Sheets

INKJET RECORDING APPARATUS

CROSS REFERENCE TO RELATED APPLICATION

This application claims priority to and the benefit of Japanese Patent Application No. 2007-074330, filed Mar. 22, 2007, the entire disclosure of which is incorporated herein by reference.

BACKGROUND OF THE INVENTION

1. Field of the Invention

The invention relates to an inkjet recording apparatus having an inkjet head that ejects ink droplets.

2. Description of Related Art

A known inkjet recording apparatus includes an inkjet head and a maintenance unit configured to perform maintenance of the inkjet head. The maintenance unit includes a cap and a blade that functions as a wiper. In known inkjet recording apparatuses, dust may adhere to ink accumulating in a boundary between the protrusion of the cap and the nozzle surface to form lumps. When the blade wipes the nozzle surface, the impurities on the nozzle surface may be spread across the nozzle surface and adhere around openings of the nozzles.

SUMMARY OF THE INVENTION

In an embodiment of the invention, an inkjet recording apparatus comprises an inkjet head comprising an ejection surface. The ejection surface comprises a first end and a second end opposite the first end, a first and second control portion, and a contact portion positioned between the first and second control portion, and a plurality of ejection ports formed therethrough. The inkjet recording apparatus also comprises a wiper and a wiper moving mechanism configured to move between the first end of the ink ejection surface and the second end of the ejection surface, wherein when the wiper is positioned over the contact portion, the wiper contacts the ejection surface, and when the wiper is positioned over the first or second control portions, the wiper is positioned a predetermined nonzero distance away from the ink ejection surface.

In another embodiment of the invention, an inkjet recording apparatus comprises an inkjet head comprising an ejection surface. The ejection surface comprises a first end and a second end opposite the first end a first contact position and a second contact position, wherein both the first contact position and the second contact position are positioned between the first and second end; and a plurality of ejection ports formed therethrough. The inkjet recording apparatus also comprises a wiper and a wiper moving mechanism configured to move between the first end of the ink ejection surface and the second end of the ejection surface, wherein when the wiper is positioned between the first end and the first contact position, or when the wiper is positioned between the second end and the second contact position, the wiper is positioned a predetermined distance from the ejection surface, and wherein when the wiper is positioned between the first and second contact positions, the wiper contacts the ejection surface.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF PREFERRED EMBODIMENTS

Preferred embodiments of the present invention, and their features and advantages, may be understood by referring to accompanying drawings, like numerals being used for corresponding parts in the various drawings.

Figure 1:
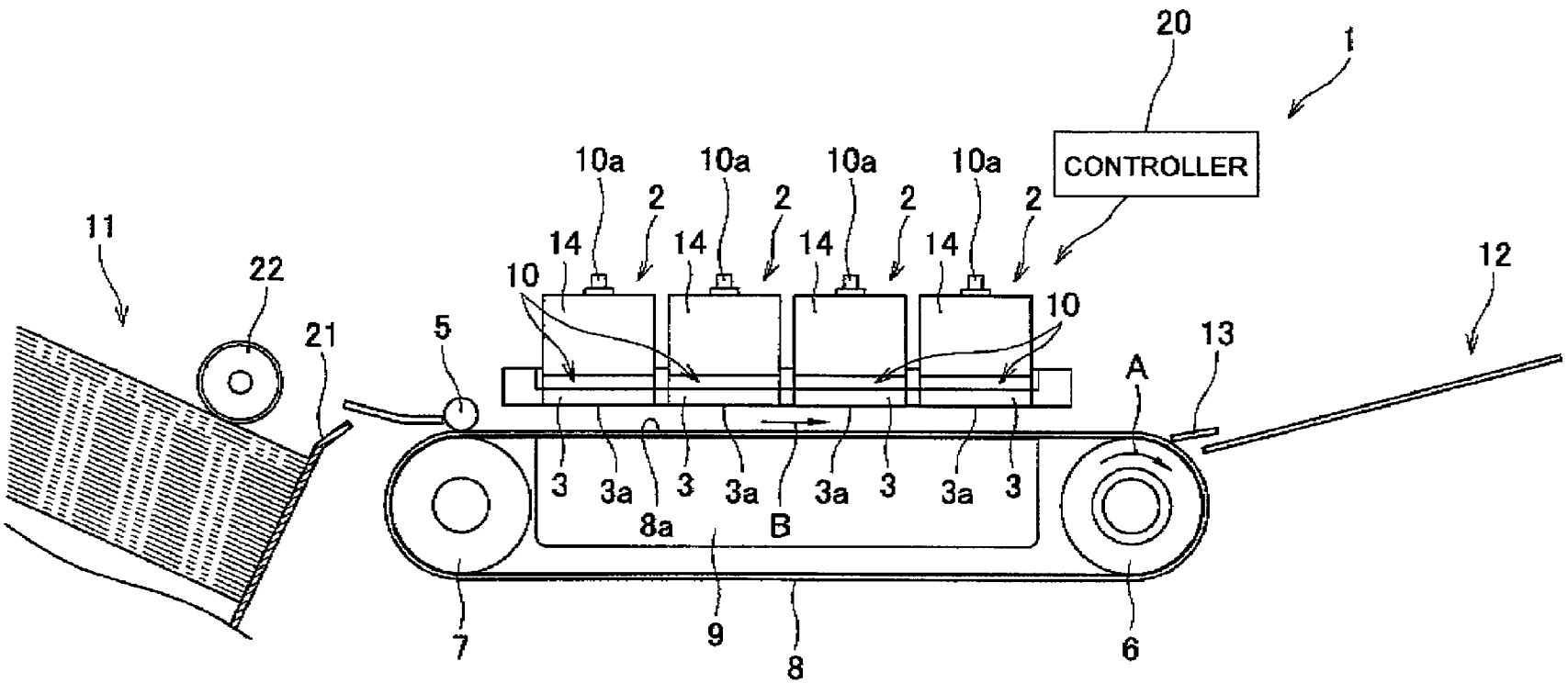
FIG. 1 is a schematic cross-sectional view of an inkjet printer according to an embodiment of the invention.

As shown in FIG. 1, an inkjet recording apparatus e.g., an inkjet printer 1, may be a color inkjet printer having a plurality of, e.g., four, inkjet heads 2. Inkjet printer 1 may include a controller 20 configured to control the inkjet printer 1. Inkjet printer 1 may be provided with a sheet supply mechanism 11 shown on the left side of FIG. 1 and a sheet ejection portion 12 shown on the right side of FIG. 1.

Inkjet printer 1 may be formed with a sheet feed path, in which a recording sheet may be fed from sheet supply mechanism 11 to sheet ejection portion 12. Sheet supply mechanism 11 may include a pickup roller 22 configured to pick up and feed an uppermost recording sheet of a stack of recording sheets stored in a sheet tray 21. The recording sheet may be fed from left to right of FIG. 1, by pickup roller 22. Two belt rollers 6, 7, and an endless conveyor belt 8, stretched between the belt rollers 6, 7, may be disposed in a central portion of the sheet feed path. An outer surface of conveyor belt 8, or a feeding surface 8*a*, may be treated with a substance, e.g., silicon, to increase the adhesion of the outer surface. A presser roller 5 may be positioned facing conveyor belt 8, directly downstream of sheet supply mechanism 11. Presser roller 5 may hold the recording sheet fed from the sheet supply mechanism 11 against the feeding surface 8*a* of the conveyor belt 8. Thus, the recording sheet held against feeding surface 8*a* may be fed to a downstream side, while being substantially adhered to feeding surface 8*a*. At this time, a drive motor (not shown) may drive belt roller 6, positioned on a downstream side with respect to a sheet feed direction B. e.g., a direction from left to right in FIG. 1, causing belt roller 6 to rotate clockwise, e.g., in an arrow direction A in FIG. 1.

A separation member 13 may be positioned along sheet feed direction B, directly downstream of the conveyor belt 8. Separation member 13 may be configured to separate the recording sheet held by feeding surface 8*a* of conveyor belt 8 from feeding surface 8*a*, and to feed the recording sheet to sheet ejection portion 12.

A platen 9 may have a substantially rectangular solid shape, and may be positioned in an area enclosed by conveyor belt 8. Platen 9 may contact a lower surface of conveyor belt 8, at a position where an upper portion of conveyor belt 8 may face inkjet heads 2, thus supporting conveyor belt 8 from the inner circumferential side of conveyor belt 8.

Figure 2:
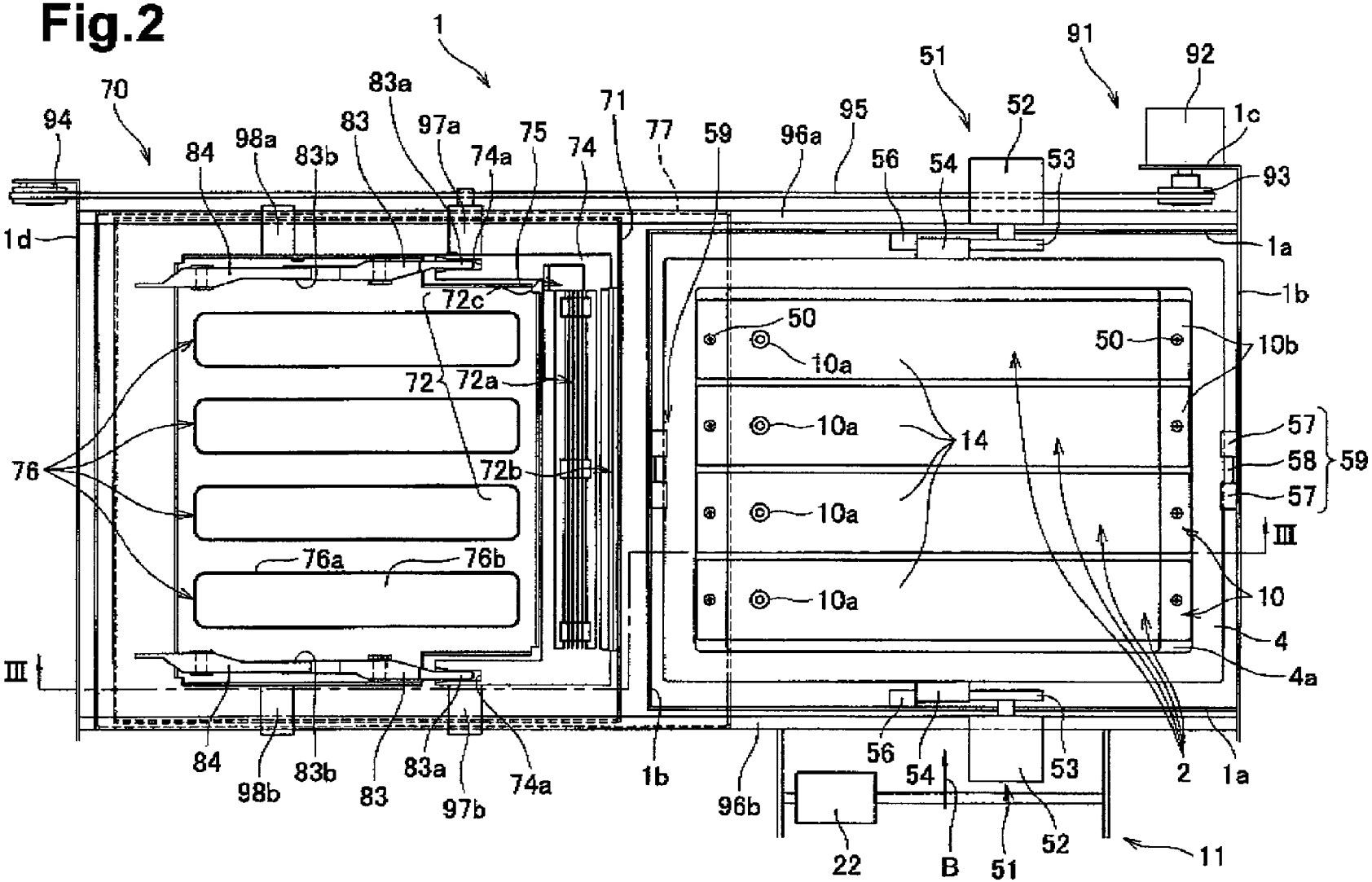
FIG. 2 is a schematic plan view of a main portion of the inkjet printer of FIG. 1, according to an embodiment of the invention.
Figure 3:
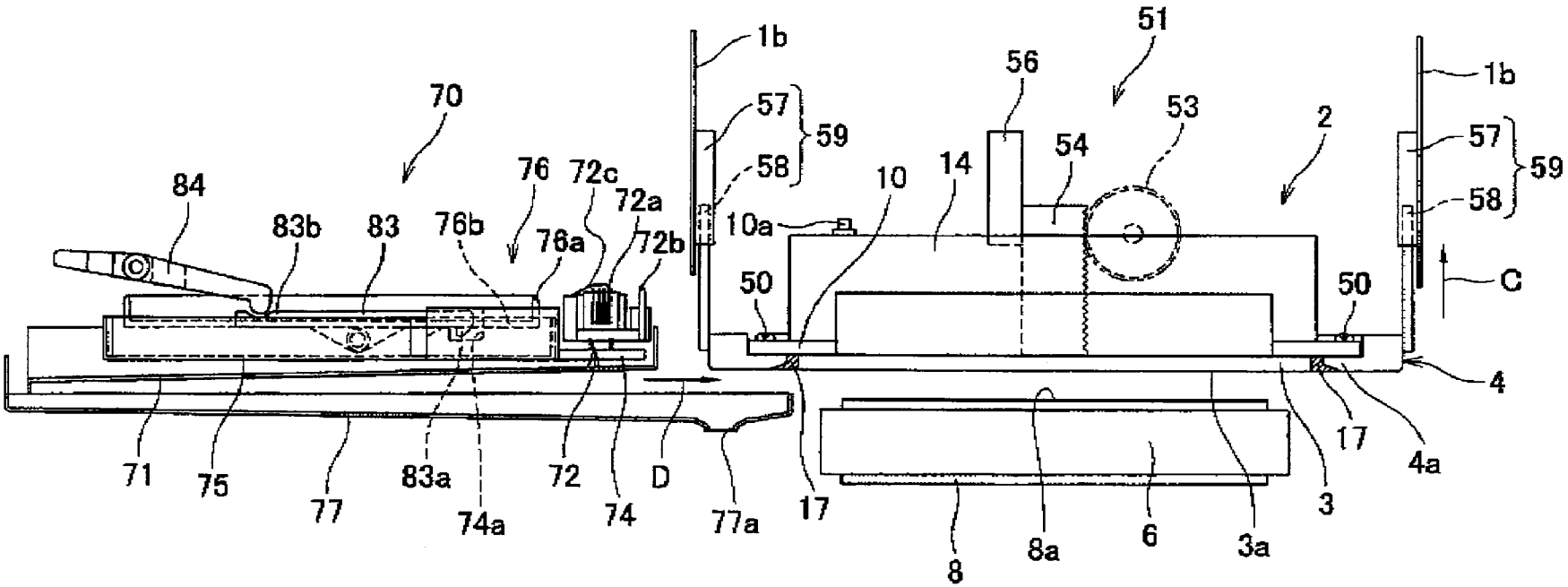
FIG. 3 is a cross-sectional view taken along a line III-III of FIG. 2.

Inkjet printer 1 may be a line-type printer. Inkjet heads 2 may correspond to a plurality of, e.g., four, colors of ink, such as magenta, yellow, cyan, and black, respectively. Referring to FIG. 2, the inkjet heads 2 may be arranged in a line along sheet feed direction B. e.g., a direction from down to up. Inkjet heads 2 may be elongated in a direction perpendicular to sheet feed direction B, and may have a substantially rectangular solid shape. Referring now to FIGS. 1 and 3, each inkjet head 2 may include a head body 3 on a bottom end. Head body 3 may be a laminated body, in which a flow path unit and actuators may be bonded. The flow path unit may be formed with ink paths, including pressure chambers, and the actuators may be configured to apply pressure to ink in the pressure chambers.

A reservoir unit 10 may be fixed to an upper surface of each head body 3. Reservoir unit 10 may be partially covered by a cover 14 and may be configured to temporarily store ink. Reservoir unit 10 may be connected to a tube joint 10*a* fixed to an upper surface of the cover 14. An ink reservoir that may store ink supplied from the tube joint 10*a* may be formed inside reservoir unit 10. As shown in FIG. 4A, a number of ink ejection ports, e.g., minute diameter nozzles 3*b*, may be arranged on a bottom surface of each head body 3. The bottom surface may be a nozzle surface, e.g., an ink ejection surface 3*a*, and may face feeding surface 8*a*. A water repellent film (not shown) may be formed on ink ejection surface 3*a*. The water repellent film may be configured to prevent adherence of excessive ink around the nozzles 3*b*. Each reservoir unit 10 may be formed longer than head body 3, with respect to the direction perpendicular to sheet feed direction B. Each reservoir unit 10 may include head fixing portions 10*b* extending toward both ends of head body 3, with respect to the length direction of head body 3. Head fixing portions 10*b* may be designed to fix reservoir unit 10 to a frame 4.

Head body 3 may be positioned such that ink ejection surface 3*a* is parallel to feeding surface 8*a* of conveyor belt 8, and such that there may be a small gap between ink ejection surface 3*a* and feeding surface 8*a*. The gap may be part of the sheet feed path. With this structure, when the recording sheet fed on conveyor belt 8 passes directly under head bodies 3, each color of ink is ejected from nozzles 3*b* toward an upper surface, or a print surface, of the recording sheet, thereby forming a desired color image on the recording sheet.

Figure 4:
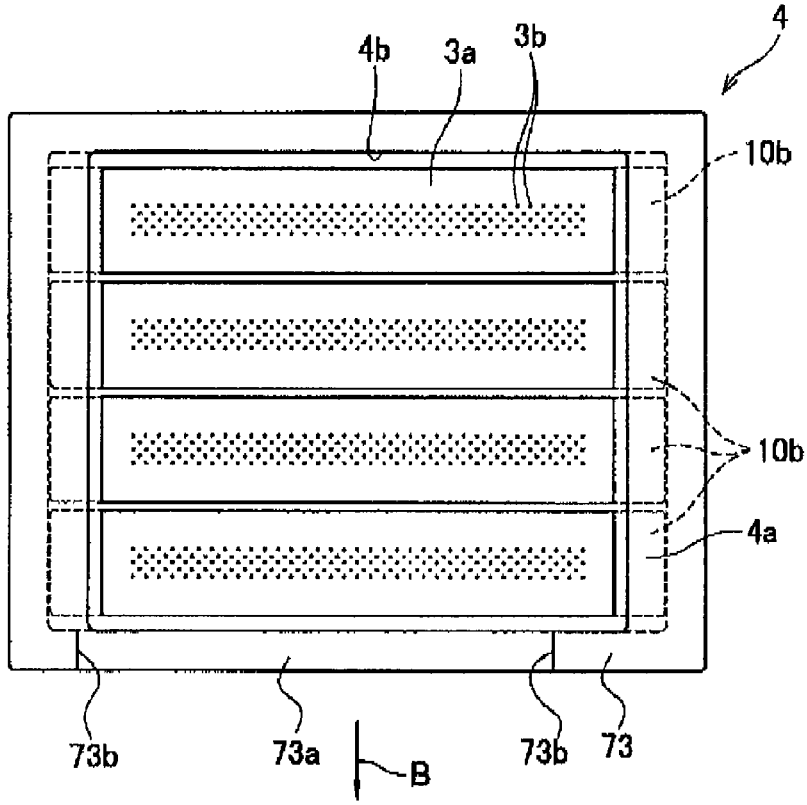
FIG. 4 is a bottom view of the inkjet heads of FIG. 1, according to an embodiment of the invention.
Figure 6A:
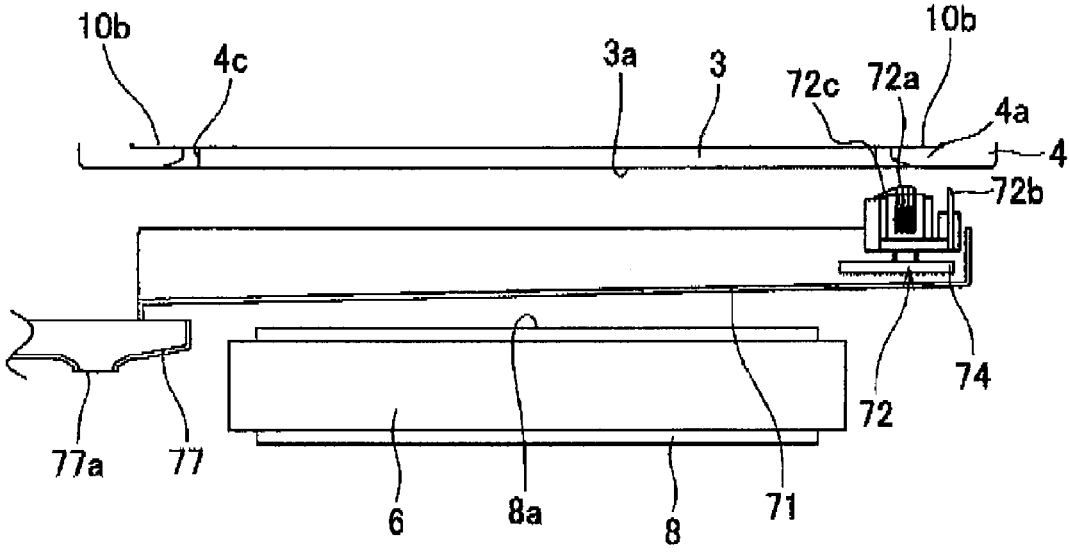
FIG. 6A is a view illustrating movement of an inkjet head of FIG. 2, and a movement of a tray of a maintenance unit, according to an embodiment of the invention.

Referring to FIG. 2, inkjet heads 2 may be arranged adjacently along sheet feed direction B, and may be attached to frame 4. Referring again to FIGS. 3 and 4, frame 4 may include supporting portions 4*a*, which may protrude to a position facing a lower surface of reservoir unit 10 at each end, with respect to the direction of the length of reservoir unit 10. Supporting portions 4*a* and both ends of reservoir unit 10 may be fixed by screws 50. In this manner, inkjet heads 2 may be enclosed by and attached to the frame 4. Referring to FIGS. 4, 7A, and 7B, a guide rail 73 may be formed on a lower surface of the frame 4. Guide rail 73 may be positioned on a downstream side with respect to sheet feed direction B, and may extend in a direction perpendicular to sheet feed direction B, or, as shown in FIG. 6, in a wiping direction E. Guide rail 73 may be configured to guide positioning member 72*c* of wiper unit 72. Guide rail 73 may include a central portion, e.g., recessed portion 73*a*. Both sides of recessed portion 73*a* are side surfaces 73*b*, perpendicular to a bottom surface of recessed portion 73*a*, with respect to wiping direction E.

Referring again to FIGS. 2 and 3, frame 4 may be supported by a pair of frame moving mechanisms 51 provided in printer 1. Frame 4 may move vertically when the frame is positioned as shown in FIGS. 2 and 3. As shown in FIG. 2, frame moving mechanisms 51 may be positioned outside inkjet heads 2. Each frame moving mechanism 51 may include a drive motor 52 as a drive source to move frame 4 vertically, a pinion gear 53 attached to a shaft of drive motor 52, a rack gear 54 positioned uprightly in frame 4, and configured to mesh with pinion gear 53, and a guide 56 positioned to engage rack gear 54 with pinion gear 53.

Two drive motors 52 may be positioned facing each other, in sheet feed direction B, and fixed to body frame 1*a* of inkjet printer 1. Two rack gears 54 may extend vertically, and may be fixed to the periphery of frame 4 at the lower ends of rack gears 54. Rack gears 54 may slidingly contact guides 56, on an opposite side from pinion gears 53, and guides 56 may be attached to the body frame 1*a*.

In an embodiment, a plurality of, e.g., two, drive motors 52 may be synchronously driven, such that pinion gears 53 may rotate in either a normal or a reverse direction, which may cause the rack gears 54 to move substantially vertically. Along with the vertical movement of rack gears 54, frame 4 and inkjet heads 2 also may move substantially vertically.

Guide units 59 may be positioned on both sides of inkjet heads 2, with respect to their length direction. Each guide unit 59 may include a bar-shaped member 58 positioned between a plurality of, e.g., a pair, of guides 57. As shown in FIG. 3, in each guide unit 59, pair of guides 57 may extend substantially vertically, and may be attached to one of body frames 1*b*, facing each other in the direction perpendicular to sheet feed direction B. Bar-shaped member 58 may extend substantially vertically as with the guides 57, and may be fixed to a side of frame 4, and positioned in parallel with body frame 1*b*. Bar-shaped member 58 may be slidingly positioned between guides 57. When frame moving mechanisms 51 move frame 4, guide units 59 may prevent ink ejection surfaces 3*a* of inkjet heads 2 from inclining with respect to feeding surface 8*a*.

As shown in FIG. 3, frame 4 may be normally positioned in a print position in which inkjet heads 2 may eject ink droplets onto the recording sheet. Frame moving mechanisms 51 may move frame 4 to a head maintenance position, where inkjet heads 2 may be positioned above the print position. In an embodiment, a maintenance operation, e.g., a purging operation may be performed. When a purging operation, e.g., an operation to forcibly eject ink from inkjet heads 2, may be performed, ink adhering to ink ejection surface 3*a* may be wiped, and ink ejection surfaces 3*a* also may be covered with caps 76.

As shown in FIGS. 2 and 3, inkjet printer 1 may include a maintenance unit 70, positioned on the left side of inkjet heads 2 with respect to FIG. 3. Maintenance unit 70 may be configured to perform maintenance on inkjet heads 2. Referring again to FIG. 3, maintenance unit 70 may include a plurality of, e.g., two, movable trays 71, 75. Trays 71, 75 may be movable in a substantially horizontal direction. Tray 71 may have a substantially rectangular box shape, may open upward, and may be configured to hold tray 75 therein. Trays 71, 75 may be coupled to each other via an engaging unit, and may be configured to be coupled to and removed from each other as needed, e.g., for maintenance.

As shown in FIG. 3, tray 71 may be open on a side opposing inkjet heads 2. For example, when purging is performed, trays 71, 75 may be disengaged, and tray 71, which may be configured to surround tray 75, may move, leaving tray 75 in place. When maintenance unit 70 moves horizontally, as described herein, frame 4 first may move up, in a direction C, to the head maintenance position, regardless of whether recess portions 74*a* and hooks 83*a* are engaged or disengaged. As frame 4 moves up, a space may be provided between ink ejection surfaces 3*a* and sheet conveying surface 8*a* for maintenance unit 70. Then, maintenance unit 70 may move horizontally in a direction D, as shown by an arrow in FIG. 3. A waste ink tray 77 may be positioned substantially immediately below maintenance unit 70. Waste ink tray 77 may be sized such that waste ink tray 77 surrounds tray 71, when viewed in plan view. Referring again to FIG. 2, when tray 71 is moved to a right end, waste ink tray 77 may overlap with a rim of tray 71, opposite to inkjet heads 2. An ink outlet 77*a* may be positioned on waste ink tray 77 at an end closer to inkjet heads 2. Ink outlet 77*a* may pass through waste ink tray 77 in a vertical direction. Waste ink which flows onto waste ink tray 77 may flow to a waste ink reservoir (not shown) through ink outlet 77*a*.).

Figure 5:
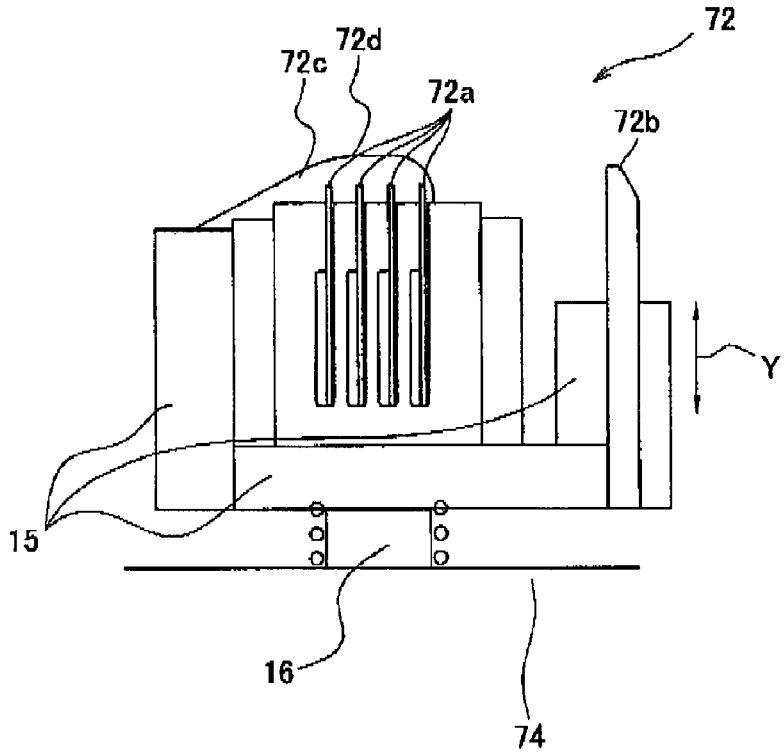
FIG. 5 is a side view of a wiper unit of FIG. 3, according to an embodiment of the invention.

A wiper unit 72 and tray 75 may be positioned in this order beginning from a side closest to inkjet heads 2, inside tray 71. Referring to FIGS. 2, 3, and 5, wiper unit 72 may include an ink receiving member 72*a*, a wiper 72*b*, a positioning member 72*c*, a supporting member 15 and an urging mechanism 16. Ink receiving member 72*a* may have a plurality of, e.g., four, thin plates, made of metal, e.g., stainless steel, that may be slightly longer than a total width of inkjet heads 2. Thin plates may be positioned in parallel, such that their length direction may be parallel to sheet feed direction B, and they also may be positioned at intervals which permit a capillary action of ink to occur. Wiper 72*b* may be a plate member made of an elastic material, e.g., rubber. Similarly to ink receiving member 72*a*, wiper 72*b* also may be slightly longer than a total width of inkjet heads 2. Wiper 72*b* may be positioned so that its length direction is parallel to sheet feed direction B and that its width direction is substantially perpendicular to a plane including ink ejection surface 3*a*. At a withdrawal position, wiper 72*b* may be positioned closer to inkjet heads 2 than ink receiving member 72*a* is, and an upper end of wiper 72*b* may be located higher than an upper end of ink receiving member 72*a*.

Positioning member 72*c* may be positioned in a vicinity of a downstream-side end of ink receiving member 72*a* with respect to sheet feed direction B. Positioning member 72*c* may be formed with a contact surface 72*d* at an upper surface. Contact surface 72*d* may be a curved surface protruding upward at a slight angle. Supporting member 15 may be configured to support ink receiving member 72*a*, wiper 72*b*, and positioning member 72*c* from beneath. Urging mechanism 16 may be configured to support supporting member 15, such that supporting member 15 may be vertically slidable, and such that urging mechanism 16 may urge supporting member 15 upward. Urging mechanism 16 may be held in a holding member 74. This configuration may allow ink receiving member 72*a*, wiper 72*b* and positioning member 72*c* to move substantially together, either vertically or in a direction perpendicular to ink ejection surfaces 3*a*.

Ink receiving member 72*a* and wiper 72*b* may be positioned such that their upper ends are below contact surface 72*d* of positioning member 72*c*, for their respective predetermined distances. The upper end of the ink receiving member 72*a* may be separated from contact surface 72*d* by a further distance than the upper end of wiper 72*b* is separated from contact surface 72*d*. Further, a distance from the upper end of ink receiving member 72*a* to contact surface 72*d* is predetermined, such that when wiper 72*b* wipes ink ejection surfaces 3*a*, the upper end of ink receiving member 72*a* may be separated from ink ejection surfaces 3*a* by a specified distance.

Tray 75 may include inside a plurality, e.g., four, caps 76. Referring to FIG. 2, each cap 76 may have a rectangular plane shape, and caps 76 may be arranged corresponding to ink ejection surfaces 3*a* of inkjet heads 2. Caps 76 may be positioned parallel to inkjet heads 2, with respect to the length direction, and at substantially the same intervals between inkjet heads 2 with respect to sheet feed direction B. Each cap 76 may have an annular protrusion 76*a* protruding upward from a bottom portion 76*b*. Each cap 76 also may be recessed, and when annular protrusion 76*a* contacts corresponding ink ejection surface 3*a*, annular protrusion 76*a* and ink ejection surface 3*a* may create a hermetically sealed space. Caps 76 may cover ink ejection surfaces 3*a* in this manner, which may reduce or prevent the drying of ink in the nozzles. Caps 76 may be made of an elastic material, e.g., rubber. Thus, ink ejection surfaces 3*a* and annular protrusions 76*a* easily may adhere to each other. This adhesion may allow each cap 76 and corresponding ink ejection surface 3*a* to maintain air tightness in an area enclosed by cap 76 and corresponding ink ejection surface 3*a*, and also may prevent ink ejection surfaces 3*a* from damage.

Figure 8A:
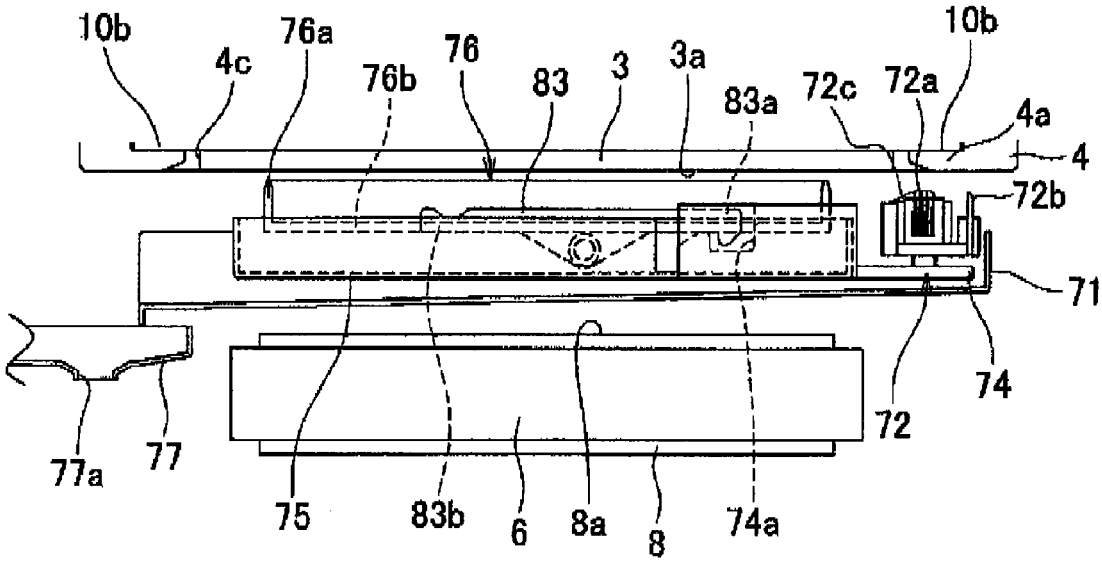
FIG. 8A is a view illustrating the maintenance unit of FIG. 2 arriving at the maintenance position, according to an embodiment of the invention.
Figure 8B:
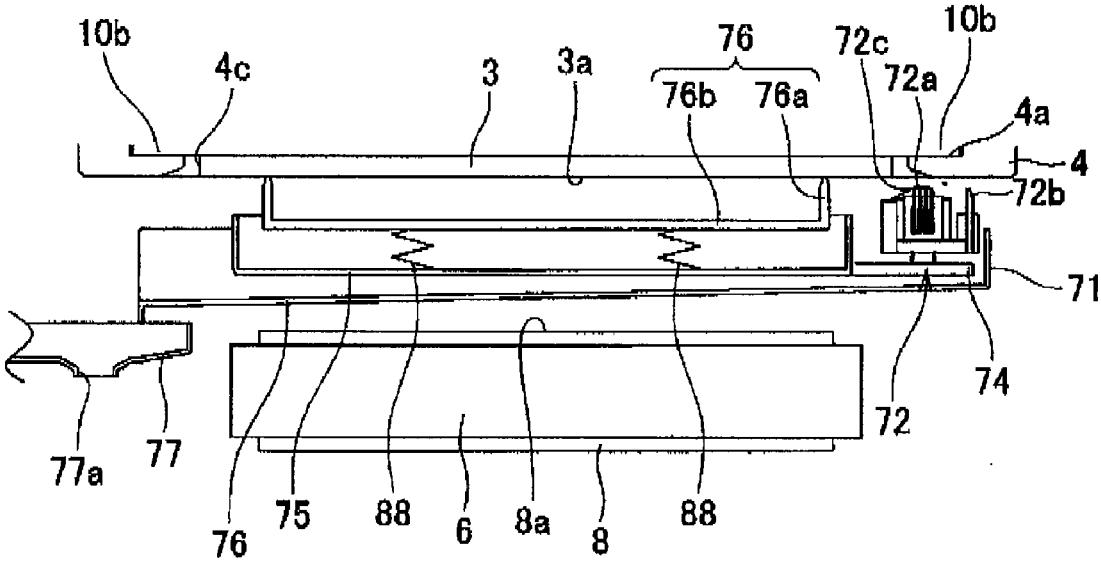
FIG. 8B is a view illustrating an annular protrusion of a cap in contact with the ink ejection surface, according to an embodiment of the invention.

As shown in FIG. 8B, each cap 76 may be supported at the bottom surface of tray 75. A plurality of, e.g., two, springs 88 and may urge each cap 76 upward. Springs 88 may reduce an impactive force that may be generated when annular protrusion 76*a* of cap 76 contacts ink ejection surface 3*a*. Springs 88 also may elastically hold cap 76 and ink ejection surface 3*a* in contact by causing annular protrusion 76*a* of cap 76 to contact ink ejection surface 3*a*.

Referring again to FIG. 2, holding member 74 may be fixed to tray 71 at an end closest to inkjet heads 2, and may have a squared-off U shape when viewed in a plan view. Wiper unit 72 may be held in a portion of holding member 74, which may be positioned parallel to sheet feed direction B. Engaging portions, e.g., recessed portion 74*a*, may be formed on ends of holding member 74, extending in the direction perpendicular to sheet feed direction B.

Trays 71, 75 may be coupled to each other via the engaging devices. The engaging devices may be positioned substantially at the top and bottom ends of trays 71, 75, when trays 71, 75 are viewed in a plan view as shown in FIG. 2. The engaging devices may include recessed portions 74, which may be positioned in holding member 74, and hook members 83, which may be rotatably supported by tray 75. Hook members 83 may extend in the direction perpendicular to sheet feed direction B, and tray 75 may rotatably support hook members 83 substantially at their center. Each hook member 83 may include a hook portion 83*a* at an end of hook member 83 closest to the inkjet heads 2. Hook portion 83*a* may be configured to engage corresponding recessed portion 74*a*. Contact members 84 may be rotatably supported above maintenance unit 70, and may be configured to contact ends 83*b* of hook member 83 located furthest from inkjet heads 2. When contact members 84 rotate in contact with ends 83*b*, hook portions 83*a* may disengage from recessed portions 74*a*. As shown in FIG. 3, when contact members 84 separate from ends 83*b*, hook portions 83*a* may engage recessed portions 74*a*.

When maintenance is not performed, maintenance unit 70 may be positioned in a withdrawal position, which may be far from inkjet heads 2. The left side of FIG. 2, including maintenance unit 70, may not face inkjet heads 2. When maintenance is performed, maintenance unit 70 may move substantially horizontally from the withdrawal position to a maintenance position. When maintenance unit 70 is in the maintenance position, maintenance unit 70 may face ink ejection surfaces 3*a* of inkjet heads 2. At this time, as inkjet heads 2 may be located in the head maintenance position, and wiper 72 and tops of annular protrusions 76*a* may be unable to contact ink ejection surfaces 3*a*.

In maintenance, for example, during a purging operation, tray 75 may remain at the withdrawal position, and tray 71 may move under the inkjet heads 2 from the withdrawal position, to receive discharged ink. When ink ejection surfaces 3*a* are covered with caps 76, trays 71, 75 may be coupled to each other via the engaging devices, and may move to the maintenance position. Trays 71, 75 may be movably supported by a pair of guide shafts 96*a*, 96*b* extending in the direction perpendicular to sheet feed direction B. Tray 71 may include a plurality of, e.g., two, bearing members 97*a*, 97*b* that may protrude from the top and bottom sides of holding member 74. Tray 75 may include a plurality of, e.g., two, bearing members 98*a*, 98*b* that may protrude from the top and bottom sides of tray 75. Guide shafts 96*a*, 96*b* may be fixed to body frames 1*b*, 1*d*, at their ends, respectively, and may be positioned in parallel to each other, between frames 1*b*, 1*d*. As shown in FIG. 3, with this configuration, trays 71, 75 may move along guide shafts 96*a*, 96*b*, in a leftward direction shown by arrow D.

A horizontal moving mechanism 91 may be configured to move trays 71, 75 substantially horizontally. As shown in FIG. 2, horizontal moving mechanism 91 may include a motor 92, a motor pulley 93, an idle pulley 94, a timing belt 95, and guide shafts 96*a*, 96*b*. Motor 92 may be fixed, e.g., attached to an attaching part 1*c*, which may be formed at an end of body frame 1*b* and may extend parallel to sheet feed direction B. Motor pulley 93 may be connected to motor 92, and may rotate along with the drive of motor 92. Idle pulley 94 may be rotatably supported by body frame 1*d*, located on the left side, when inkjet printer 1 is positioned as shown in FIG. 2. Timing belt 95 may be positioned in parallel to guide shaft 96*a*, and may be stretched between motor pulley 93 and idle pulley 94. Timing pulley 95 may be coupled to bearing member 97*a*, and may be positioned in holding member 74.

With this configuration, when motor 92 is driven, motor pulley 93 may rotate in a normal or reverse direction, and timing belt 95 may run according to the drive direction of motor pulley 93. Tray 71 may be connected to timing belt 95 via bearing member 97*a*, and may move to the withdrawal position or to the maintenance position, e.g., to the left or to the right, respectively, when inkjet printer 1 is positioned as shown in FIG. 2. When hook portions 83*a* engage recessed portions 74*a* of holding member 74, wiper unit 72, positioned in tray 71, and caps 76, positioned in tray 75, may move substantially together to the withdrawal position or to the maintenance position. When hook portions 83*a* disengage from recessed portions 74*a*, wiper unit 72, positioned in tray 71, may move to the withdrawal position or to the maintenance position.

Referring to FIGS. 6A, 6B, 7A, 7B, 8A and 8B, maintenance unit 70 may operate as described herein. When a maintenance operation, e.g., a purging operation is performed, e.g., to restore inkjet head 2 when inkjet head 2 has an ejection problem, frame moving mechanisms 51 may move frame 4 upward. Referring back to FIG. 3, at this time, a plurality of, e.g., two, drive motors 52 may be synchronously driven such that pinion gears 53 rotate in the normal direction, e.g., clockwise when pinion gears are arranged. The rotation of pinion gears 53 may cause rack gears 54 to move upward. Frame 4, which may be fixed to rack gears 54, also may move upward, along with inkjet heads 2. When frame 4 and inkjet heads 2 arrive at the head maintenance position, drive motors 52 may stop. This may allow maintenance unit 70 to move to a space between ink ejection surfaces 3*a* and conveyor belt 8. Thus, ink ejection surfaces 3*a* of inkjet heads 2 the bottom surface of frame 4 may be located at positions, e.g., when in inkjet heads 2 are in the head maintenance position, such that wiper 72 and the tops of annular protrusions 76*a* may be unable to contact ink ejection surfaces 3*a* and the bottom surface of frame 4, and maintenance unit 70 may move to the maintenance position.

Contact members 84 may contact with ends 83*b* of hook members 83, such that hook portions 83*a* may disengage from recessed portions 74*a*, which may cause trays 71, 75 to uncouple. With trays 71, 75 uncoupled, motor 92 of horizontal moving mechanism 91 may drive timing belt 95, and the running of timing belt 95 may cause tray 71 to move to the maintenance position. As shown in FIG. 6A, when tray 71 arrives at the maintenance position, motor 92 may stop. To perform a purging operation, once tray 71 is in the maintenance position, a pump (not shown) to force ink in the ink tank (not shown) to flow into inkjet heads 2 may be driven, for ejecting ink from nozzles 3*b* of inkjet heads 2 to tray 71. Due to the purging operation, ejection problems at nozzles 3*b*, such as clogging, and increased viscosity of ink, may be solved. Ink purged into tray 71 may move along the bottom surface of the tray 71, e.g., in a leftward direction when tray 71 is positioned as shown in FIG. 8B. Ink also may flow into waste ink receiving tray 77. The purged ink may be discharged from ink discharge hole 77*a* of waste ink receiving tray 77. Purged ink also may partially remain on ink ejection surfaces 3*a*, in the form of ink droplets.

Figure 6B:
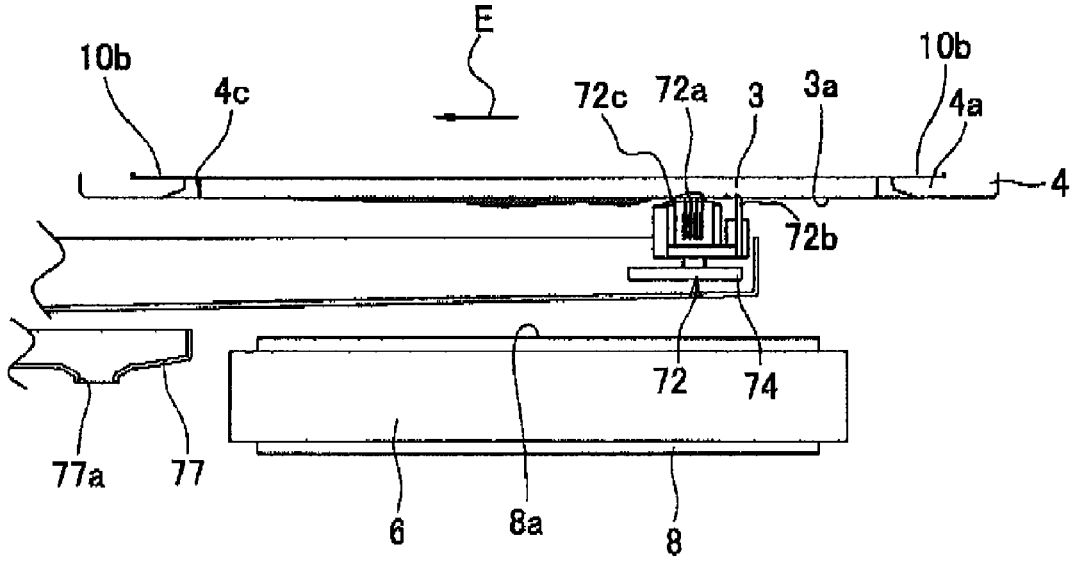
FIG. 6B is a view illustrating an ink receiving member and a wiper of FIG. 2, according to an embodiment of the invention.
Figure 7A:
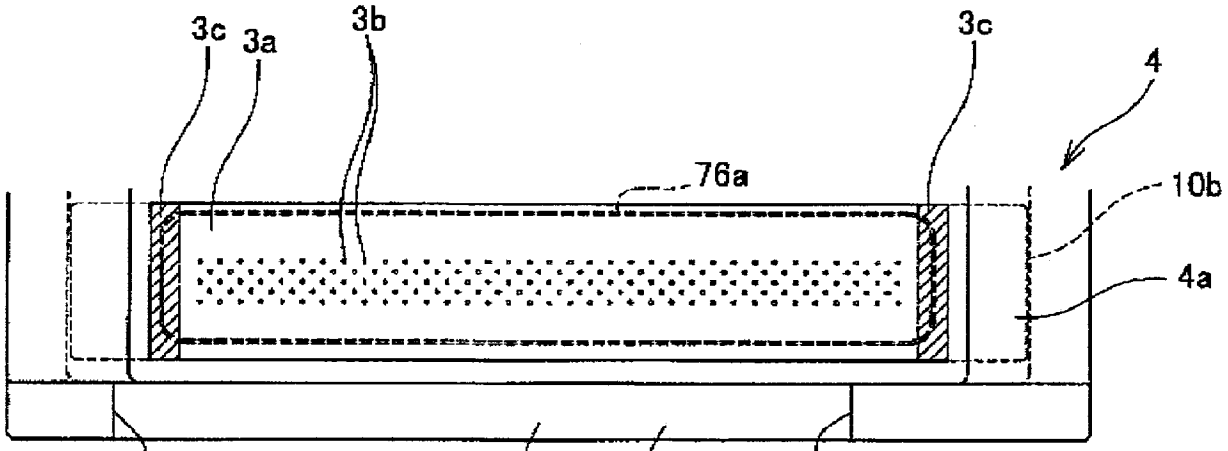
FIG. 7A is a plan view of a guide rail of FIG. 4, according to an embodiment of the invention.
Figure 7B:
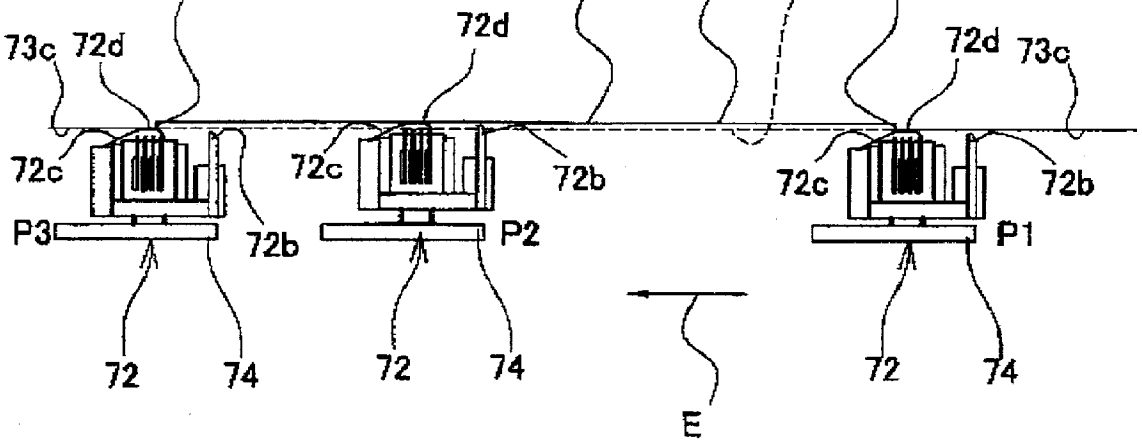
FIG. 7B is a view illustrating movement of the wiper unit of FIG. 2, according to an embodiment of the invention.

As shown in FIG. 6B, frame moving mechanisms 51 may move inkjet heads 2 downward. Horizontal moving mechanism 91 may move tray 71 in a wiping direction E, from the maintenance position to the withdrawal position, and wiping may be performed.

As shown in FIG. 7A, when ink ejection surface 3*a* is covered with cap 76, annular protrusion 76*a* of cap 76 may contact ink ejection surface 3*a*. Ink ejection surface 3*a* may include rectangular-shaped control areas 3*c* at both ends of ink ejection surface 3*a*, with respect to wiping direction E. When annular protrusion 76*a* contacts ink ejection surface 3*a*, both ends of annular protrusion 76*a*, with respect to wiping direction E, may be located in control areas 3*c*. When annular protrusion 76*a* contacts ink ejection surface 3*a*, a quantity of ink remaining on ink ejection surface 3*a* may react with annular protrusion 76*a* and a deposit may be formed. Alternatively, dust suspended in the air may adhere to ink accumulating in a boundary between ink ejection surface 3*a* and annular protrusion 76*a*, which may form lumps. Thus, even if annular protrusion 76*a* is separated from ink ejection surface 3*a*, impurities, e.g., deposits or lumps, may adhere to an area of ink ejection surface 3*a* which may contact annular protrusion 76*a*. Thus, control areas 3*c* on ink ejection surface 3*a* include areas in which impurities may be spread in a direction perpendicular to wiping direction E.

During wiping, horizontal moving mechanism 91 may move tray 71 to the maintenance position, and frame moving mechanisms 51 then may move inkjet heads 2 downward. As shown in FIG. 7B, contact surface 72*d* of positioning member 72*c* of wiper unit 72 may contacts an upstream-side area of recessed portion 73*a* of guide rail 73, with respect to wiping direction E. This area, which may be provided on a lower surface of frame 4, may be a control surface 73*c* that may position the upper end of wiper 72*b* away from inkjet ejection surfaces 3*a*. Control surface 73*c* also may be formed downstream, in wiping direction E, of recessed portion 73*a*. With this configuration, guide rail 73 may press positioning member 72*c*, e.g., control surface 3*c* on an upstream side, and ink receiving member 72*a*, wiper 72*b* and positioning member 72*c* may move downward, in a direction perpendicular to ink ejection surfaces 3*a*, along with supporting member 15. At this time, ink ejection surfaces 3*a* may be positioned such that they are level with control surface 73*c*, and the upper end of wiper 72*b* may be located downward from a plane including ink ejection surfaces 3*a*, e.g., position P1 of FIG. 7B.

In this state, horizontal moving mechanism 91 may move tray 71 toward wiping direction E from the maintenance position, such that contact surface 72*d* of positioning member 72*c* may move in wiping direction E while contacting control surface 73*c*. At this time, control surface 73*c* may press contact surface 72*d* of positioning member 72*c* until contact surface 72*d* reaches a side surface 73*b*, on an upstream side of guide rail 73, with respect to wiping direction E. Thus, the upper end of wiper 72*b* may remain positioned below a plane including ink ejection surfaces 3*a*. The upper end of wiper 72*b* may pass an area facing upstream-side control area 3*c*, with respect to wiping direction E, while remaining separated from ink ejection surfaces 3*a*.

As horizontal moving mechanism 91 moves tray 71 in wiping direction E, contact surface 72*d* of positioning member 72*c* may move over upstream-side side surface 73*b* of guide rail 73 and may reach recessed portion 73*a*. At this time, urging mechanism 16 may cause ink receiving member 72*a*, wiper 72*b*, and positioning member 72*c* to move together with supporting member 15 in an upward direction, e.g., in the direction perpendicular to ink ejection surfaces 3*a*, such that contact surface 72*d* contacts recessed portion 73*a*.

A depth of recessed portion 73*a* may be set such that when contact surface 72*d* contacts recessed portion 73*a*, the upper end of ink receiving member 72*a* may be positioned at a predetermined distance from ink ejection surfaces 3*a*. With this setting, droplets of ink, which may be relatively large-sized, may adhere to ink ejection surfaces 3*a*. During purging, these droplets of ink may move between the thin plates of ink receiving member 72*a* by capillary action. While wiper 72*b* faces the area between control areas 3*c* provided on each ink ejection surface 3*a*, wiper 72*b* may bend and slide on ink ejection surfaces 3*a*, while moving together with ink receiving member 72*a*, because the upper end of wiper 72*b* may be above the lower surface of frame 4. In this manner, wiper 72*b* may wipe ink remaining on ink ejection surfaces 3*a*, as shown in position P2 of FIG. 7B.

When horizontal moving mechanism 91 moves tray 71 further in wiping direction E, contact surface 72*d* of positioning member 72*c* may move over downstream-side side surface 73*b* of guide rail 73, with respect to wiping direction E, and may contact downstream-side control surface 73*c*. Positioning member 72*c* may be pressed by control surface 73*c*, and ink receiving member 72*a*, wiper 72*b*, and positioning member 72*c* may move downward, together with supporting member 15. At this time, the upper end of wiper 72*b* may be located below the plane including ink ejection surfaces 3*a*, as shown in position P3 of FIG. 7B. When horizontal moving mechanism 91 moves tray 71 to the withdrawal position in wiping direction E, the upper end of wiper 72*b* may pass the area facing downstream-side control area 3*c*, while being separated from ink ejection surface 3*a*.

As described above, guide rail 73, positioning member 72*c* and urging mechanism 16 comprise a control mechanism, which may cause wiper 72*b* to move in the direction perpendicular to ink ejection surface 3*a*, and which may prevent the upper end of wiper 72*b* from contacting control area 3*c*. When horizontal moving mechanism 91 moves tray 71 to the withdrawal position, wiping may be finished.

If printer 1 is inactive for a period of time, e.g., a prolonged period of time in which printing onto recording sheets is not performed, caps 76 may cover ink ejection surfaces 3*a*]. Similarly to the above description, frame moving mechanisms 51 may move inkjet heads 2 from the print position to the head maintenance position. As shown in FIG. 8A, when trays 71, 75 are coupled via hook members 83, horizontal moving mechanism 91 may move trays 71, 75 to the maintenance position At this time, annular protrusion 76*a* of each cap 76 may be positioned facing a circumference of an area where nozzles 3*b* may be formed on corresponding ink ejection surface 3*a*.

Referring now to FIG. 8B, frame moving mechanisms 51 may move each inkjet head 2 downward, such that ink ejection surface 3*a* may be brought into contact with the top of annular protrusion 76*a*. This contact may allow ink ejection surface 3*a* to be hermetically sealed by cap 76, which may reduce or prevent drying of ink in nozzles 3*b*. Thus, horizontal moving mechanism 91 and frame moving mechanisms 51 may function as a cap moving mechanism.

According to an embodiment of inkjet printer 1, during wiping, the upper end of wiper 72*b* may be prevented from contacting control areas 3*c*. Thus, impurities adhering to control areas 3*c* may be prevented from spreading toward nozzles 3*b*. By preventing this contact, deterioration of the water repellency of ink ejection surface 3*a*, and ink ejection performance degradation caused by impurities adhering around openings of nozzles 3*b* or entering into nozzles 3*b*, may be reduced or prevented.

Figure 9:
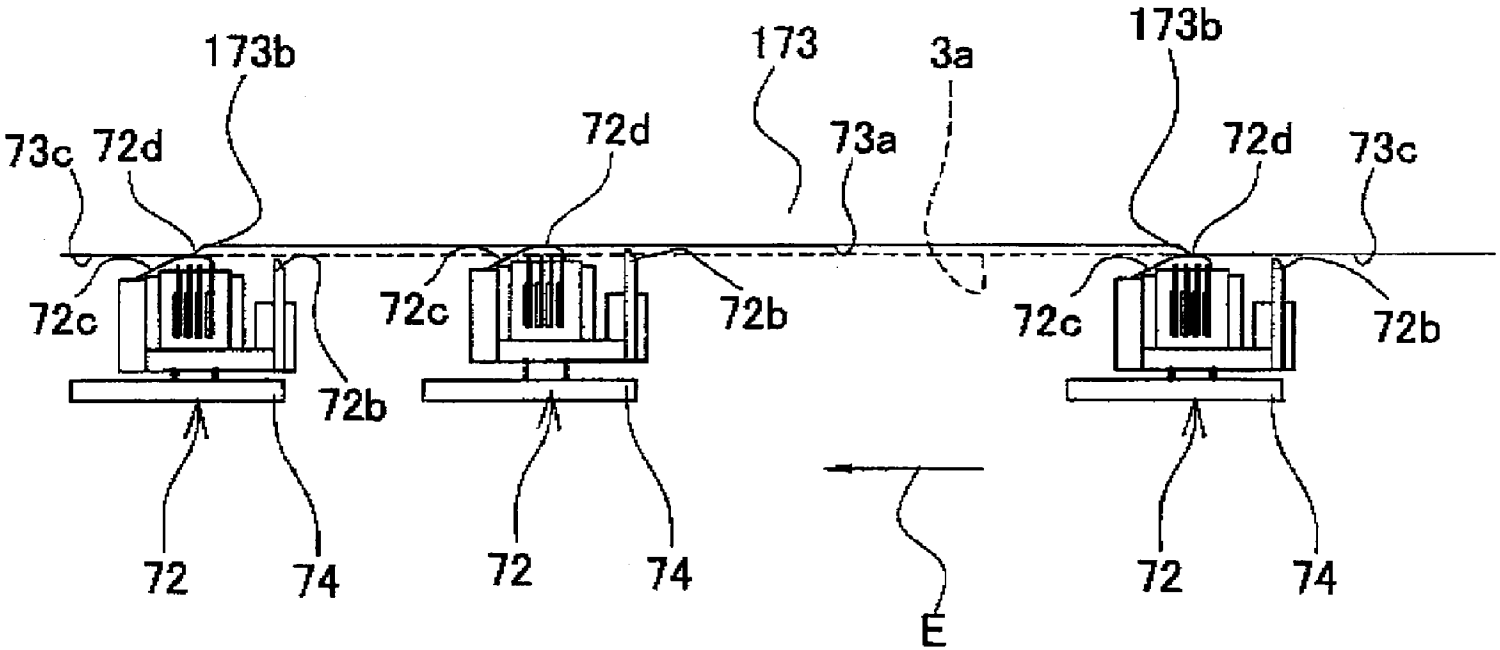
FIG. 9 is a side view of a guide rail, according to another embodiment of the invention.

In the above embodiment, both sides of recessed portion 73*a* of guide rail 73, with respect to wiping direction E, may be side surfaces 73*b*, perpendicular to the lower surface of recessed portion 73*a*. Nevertheless, in another embodiment, as shown in FIG. 9, a guide rail 173 may have curved side surfaces 173*b*. In this embodiment, contact surface 72*d* of positioning member 72*c* optionally may not be curved.

Figure 10:
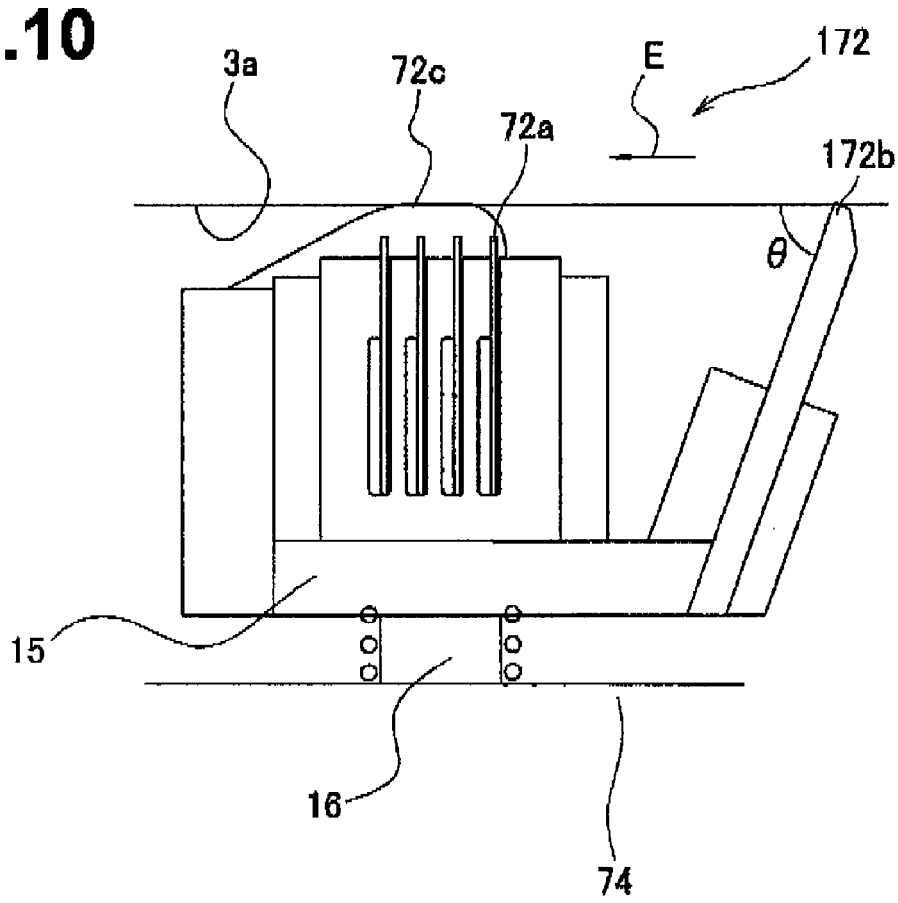
FIG. 10 is a side view of the wiper unit, according to yet another embodiment of the invention.

In the above embodiment, wiper unit 72 may be configured such that wiper 72*b* is positioned perpendicularly to ink ejection surfaces 3*a*. Nevertheless, in another embodiment, as shown in FIG. 10, a wiper unit 172 may be positioned such that a wiper 172*b* may be positioned such that wiper 172*b* contacts ink ejection surfaces 3*a* with angle. Further, wiper 172*b* may be inclined such that an upper end of wiper 172*b* may be positioned upstream with respect to wiping direction E, and a base end of wiper 172*b* may be positioned downstream with respect to wiping direction E.

Figure 11:
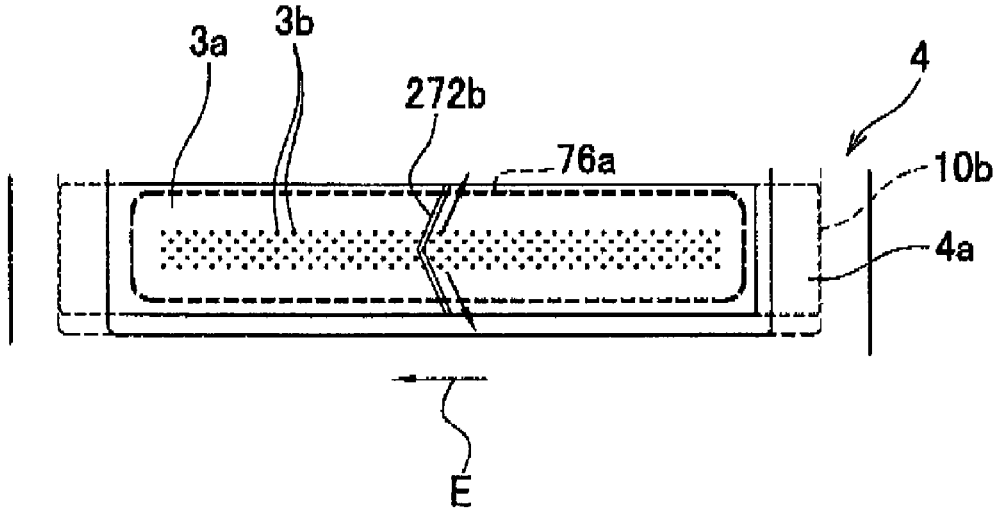
FIG. 11 is a plan view of a wiper according to a still another modification of the invention.

In the above embodiment, wiper 72*b* may be positioned such that its length direction is parallel with sheet feed direction B. Instead, a V-shaped wiper 272*b* may be positioned corresponding to each ink ejection surface 3*a*. As shown in FIG. 11, wiper 272*b* may be positioned such that an apex of a letter V is positioned in a substantially central portion of ink ejection surface 3*a*, with respect to a direction perpendicular to wiping direction E, and positioned downstream with respect to wiping direction E. Further, wiper 272*b* may have a pair of slants which may diverge from the apex, and may extend toward both sides of ink ejection surface 3*a*, with respect to the direction perpendicular to wiping direction E, and extending toward the upstream side with respect to wiping direction E.

Figure 12A:
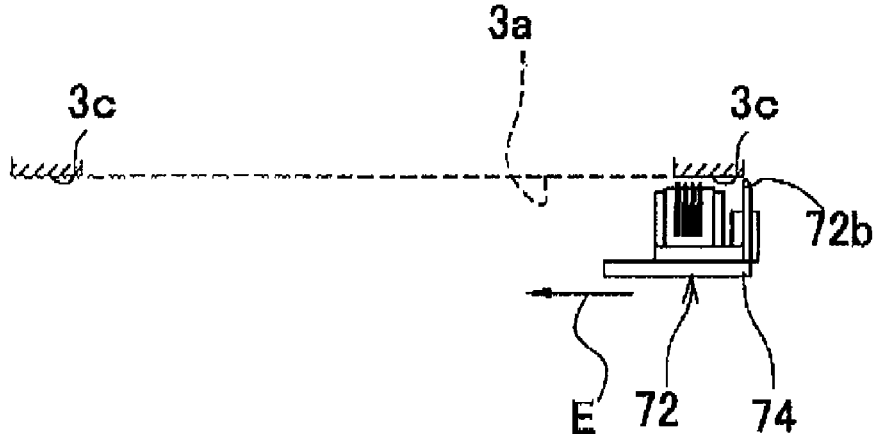
FIGS. 12A, 12B, and 12C is a view illustrating movement of a wiper unit according to another embodiment of the invention.
Figure 12B:
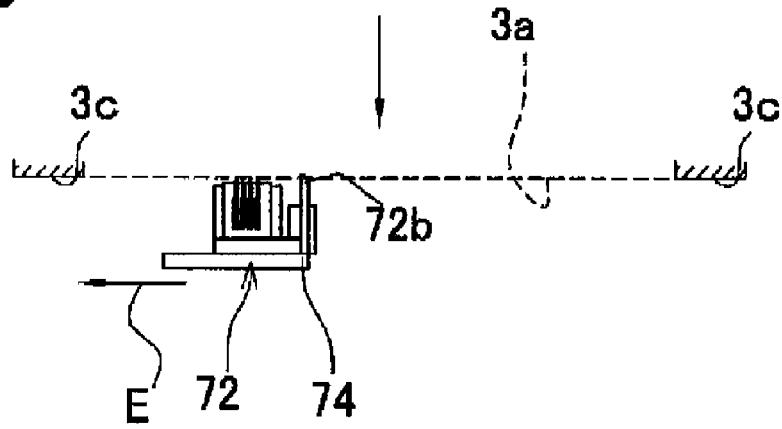
Figure 12C:
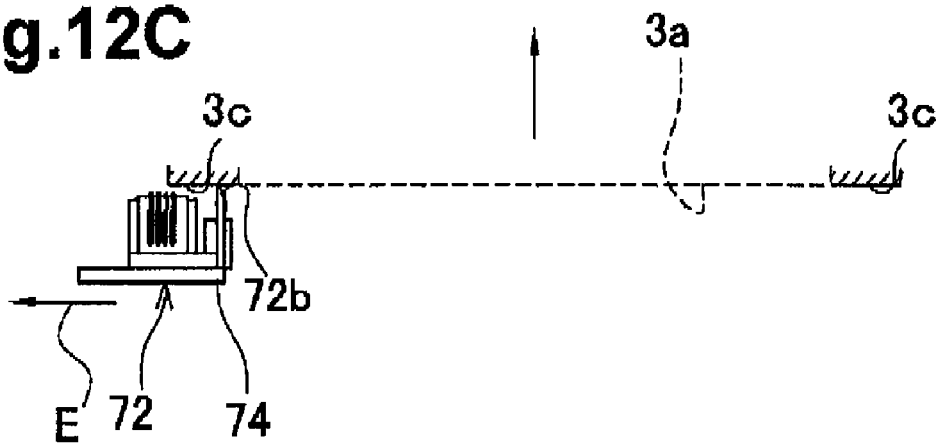

In the above embodiment, wiper 72*b* may move in the direction perpendicular to ink ejection surfaces 3*a* by the control mechanism, which may comprise guide rail 73 formed with side surfaces 73*b*, positioning member 72*c* having contact surface 72*d*, and urging mechanism 16, such that upper end of wiper 72*b* may be prevented from contacting the control areas 3*c*. Nevertheless, in another embodiment, as shown in FIGS. 12A to 12C, wiper 72*b* may be directly attached to holding member 74, and configured to move in wiping direction E. A controller 20 may allow inkjet heads 2 to move in the direction perpendicular to ink ejection surface 3*a*, such that wiper 72*b* may contact ink ejection surfaces 3*a*, when wiper 72*b* faces an area of ink ejection surface 3*a* disposed between control areas 3*c*. Wiper 72*b* wiper 72*b* also may be separated from ink ejection surface 3*a* when wiper 72*b* faces control areas 3*c*. Wiper 72*b* thus may be prevented from contacting control areas 3*c*.

In the above embodiment, during wiping, horizontal moving mechanism 91 may move wiper 72*b* and tray 71 in wiping direction E, such that wiper 72*b* may wipe ink ejection surfaces 72*b*. Nevertheless, in yet another embodiment of the invention, inkjet heads 2 may be moved in a direction opposite to wiping direction E, such that wiper 72*b* may wipe ink ejection surfaces 3*a*.

When contact surface 72*d* of positioning member 72*c* moves over an upstream-side side surface 73*b* of guide rail 73 and reaches recessed portion 73*a*, contact surface 72*d* may contact recessed portion 73*a*. If wiper 72*b* may wipe ink ejection surface 3*a*, then, in an embodiment of the invention, contact surface 72*d* may avoid contact with recessed portion 73*a*.

Although embodiments of the invention have been described in detail herein, the scope of the invention is not limited to these embodiments. It will be appreciated by those skilled in the art that various modifications may be made without departing from the scope of the invention. Accordingly, the embodiments disclosed herein are merely exemplary, and are not intended to define the scope of the invention. It is to be understood that the scope of the invention is not to be limited thereby, but is to be determined by the claims which follow.

What is claimed is:

1. A inkjet recording apparatus comprising:

an inkjet head comprising an ejection surface, the ejection surface comprising:

a first end and a second end opposite the first end;

a first and second control portion, and a contact portion positioned between the first and second control portion; and a plurality of ejection ports formed therethrough;

a wiper;

a wiper moving mechanism configured to move between the first end of the ink ejection surface and the second end of the ejection surface, wherein when the wiper is positioned over the contact portion, the wiper contacts the ejection surface, and when the wiper is positioned over the first or second control portions, the wiper is positioned a predetermined nonzero distance away from the ink ejection surface;

a guide member positioned adjacent to the inkjet head and extending from the first end to the second end; and a positioning member connected to the wiper and configured to contact the guide member, wherein the positioning member moves the wiper closer to or away from the ejection surface.

2. The inkjet recording apparatus of claim 1, further comprising:

a cap comprising a particular protrusion, wherein the particular protrusion is configured to selectively contact the ejection surface at one or both of a portion of the first control portion and a portion of the second control portion.

3. The inkjet recording apparatus of claim 2, further comprising:

a cap moving mechanism, configured to move at least one of the cap and the inkjet head from a first cap position to a second cap position, wherein when the cap and the inkjet head are in the first cap position, the particular protrusion contacts the ejection surface.

4. The inkjet recording apparatus of claim 1, wherein the positioning member moves the wiper a distance closer to or away from the ejection surface corresponding to the shape of the guide member at a point at which the positioning member contacts the guide member.

5. The inkjet recording apparatus of claim 1, further comprising an urging member configured to urge the positioning member toward the guide member.

6. The inkjet recording apparatus of claim 4, wherein the guide member comprises one or more recessed portions corresponding to the contact portion of the ejection surface, and wherein when the positioning member contacts the one or more recessed portions, the wiper contacts the ejection surface, and wherein when the wiper contacts a portion of the guide member that extends further toward the positioning member than the one or more recessed portions, the wiper is positioned a predetermined distance from the ejection surface.

7. The inkjet recording apparatus according to claim 4, further comprising a frame configured to surround the ink jet head, wherein the guide member is positioned in a portion of the frame extending from the first end of the ejection surface to the second end of the ejection surface.

8. The inkjet recording apparatus according to claim 4, wherein at least one surface of the guide member that contacts the positioning member is a curved surface.

9. The inkjet recording apparatus according to claim 1, further comprising a head moving mechanism configured to move the inkjet head in a direction perpendicular to the ink ejection surface, from a first head position to a second head position, wherein when the head is in the first head position, the ejection surface contacts the wiper, and when the head is in the second head position, the head is a predetermined nonzero distance away from the wiper.

10. The inkjet recording apparatus of claim 9, wherein the head moving mechanism moves the inkjet head to a first head position when the wiper is positioned over the contact portion, and the head moving mechanism moves the inkjet head to a second head position when the wiper is positioned over the first and the second control portions.

11. The inkjet recording apparatus according to claim 1, wherein the wiper further comprises a first wiper end and a second wiper end opposite the first wiper end, and wherein the wiper is positioned at an angle, such that the first wiper end is positioned closer to the second end of the ejection surface than the first end of the ejection surface, and the second wiper end is positioned closer to the first end of the ejection surface than the second end of the ejection surface.

12. The inkjet recording apparatus according to claim 1, wherein the wiper is positioned to incline from a center of the wiper toward both the first end and the second end of the ejection surface.

* * * * *